US005440845A

United States Patent [19]

Tadros et al.

[11] Patent Number: 5,440,845

[45] Date of Patent: Aug. 15, 1995

[54] PRECAST CONCRETE SANDWICH PANELS

[75] Inventors: Maher K. Tadros; David C. Salmon; Amin Einea; Todd D. Culp, all of Omaha, Nebr.

[73] Assignee: The Board of Regents of the University of Nebraska, Lincoln, Nebr.

[21] Appl. No.: 320,109

[22] Filed: Oct. 6, 1994

Related U.S. Application Data

[63] Continuation of Ser. No. 760,078, Sep. 13, 1991, abandoned.

[51] Int. Cl.[6] ..... E04C 2/26

[52] U.S. Cl. ..... 52/309.12; 52/410; 52/712; 52/309.7; 52/600

[58] Field of Search ..... 52/251, 258, 270, 309.07, 52/309.11-309.14, 410, 533, 782, 600, 309.16, 309.17, 712-713

[56] References Cited

U.S. PATENT DOCUMENTS

| | | | |
|---|---|---|---|
| 3,179,983 | 4/1965 | Webber et al. | 52/782 |
| 3,750,355 | 8/1973 | Blum | 52/309.12 |
| 3,879,908 | 4/1975 | Weismann | 52/309.12 |
| 4,079,560 | 3/1978 | Weismann | 52/309.7 |
| 4,104,842 | 8/1978 | Rockstead et al. | 52/309.12 |
| 4,226,067 | 10/1980 | Artzer | 52/309.12 |
| 4,283,896 | 8/1981 | Fricker et al. | 52/309.12 |
| 4,346,541 | 8/1982 | Schmitt | 52/553 |
| 4,829,733 | 5/1989 | Long | 52/309.11 |
| 4,974,381 | 12/1990 | Marks | 52/309.12 |

*Primary Examiner*—Carl D. Friedman
*Assistant Examiner*—Winnie S. Yip
*Attorney, Agent, or Firm*—Vincent L. Carney

[57] ABSTRACT

To make precast concrete sandwich panels, a first concrete slab is formed having embedded in it one end of connectors which extend from it's surface in two directions with the path between the two containing only thermally insulative material, a layer insulative material is positioned adjacent to a central portion of said connectors to form a solid layer and a second layer of concrete is cast so as to receive the upper ends of said connectors. The connectors provide resistance to shear in at least two directions and include insulative high tensile strength members extending in more than one direction between the concrete slabs.

5 Claims, 7 Drawing Sheets 10
12
12A
14
16
18
20
20A
22
22A
24
24A
26
26A
30A
32A
34A
35
36A
37
39A
50
52
X
Y
Z

PRECAST CONCRETE SANDWICH PANELS

This application is a continuation of application Ser. No. 07/760,078, filed Sep. 13, 1991, abandoned.

BACKGROUND OF THE INVENTION

This invention relates to concrete structural elements, methods of fabricating them and buildings using them.

One class of concrete structural element is called a concrete sandwich panel. It is composed of two layers, called wythes, of concrete separated by a layer of insulation. The concrete wythes are connected together through members that pass through the insulation into the concrete layers and transmit forces between the two.

In one type of prior art precast concrete sandwich panel of this class, forces are transmitted between the two concrete layers by metal trusses. These trusses are capable of transmitting force in a number of different directions such as perpendicular to the planes of the concrete layers or at angles to those planes but in the plane of the metal trusses.

The precast concrete sandwich panels which utilize metal trusses that pass through the insulation layer and are embedded in the concrete layers to hold the concrete layers together have a disadvantage in that the metal struts of the truss readily transfer heat from one concrete layer to the other through the metal. Thus there is a low resistance heat transfer path throughout the entire sandwich panel.

In another prior art type of sandwich panel, straight plastic pins are forced through the top layer of concrete, the insulative layer and into the bottom layer. They are shaped so as to be embedded and fastened to the two concrete layers and transmit forces between them. In one prior art embodiment, they are at an angle slanting downwardly so as to transmit some downward force. These panels provide good insulation between the two concrete layers.

The precast concrete sandwich panels which utilize straight plastic pins have a disadvantage in that they are not true composite panels which can transmit large vertical forces at both obtuse and acute angles to the plane of the panels with a structural outer concrete layer as they are implemented in practice. Thus, while they have better thermal insulating characteristics than the precast concrete sandwich panels in which the concrete wythes are connected by metal trusses, they have poor force transmitting characteristics.

SUMMARY OF THE INVENTION

Accordingly, it is an object of the invention to provide a novel structural element.

It is a still further object of the invention to provide a novel building.

It is a still further object of the invention to provide a novel technique for fabricating precast concrete sandwich panels.

It is a still further object of the invention to provide a novel composite precast concrete sandwich panel which has both good thermal insulating characteristics and the ability to transmit force between concrete layers in a number of different directions.

It is a still further object of the invention to provide a precast concrete sandwich panel in which the connectors take up at least 50 percent of the shear forces between the concrete wythes that would be theoretically taken up by an infinitely rigid connector connecting the two concrete wythes.

In accordance with the above and further objects of the invention, a precast concrete sandwich panel includes first and second concrete layers separated by an insulative layer which formed so that all thermal paths between the two concrete layers contain material having a thermal conductivity of no more than 3 BTUs per hour, per square foot in area, per inch in thickness with a one degree Fahrenheit difference in temperature.

The concrete layers are connected to each other through members that can transmit the force at least in planes perpendicular to the surface of the two layers and at a plurality of different angles to the surfaces of the panel within the planes at both acute and obtuse angles thereto, whereby the sandwich panel is a composite panel.

Preferably, the connectors in the insulative layer are capable of transmitting a shear force that is at least 50 percent of the shear forces between the concrete wythes that would be theoretically taken up by an infinitely rigid connector connecting the two concrete wythes. The connectors provide a tensile strength and a compressive strength along the connectors sufficient to provide this shear force and to support load on either concrete wythe. The connectors provide a shear strength between the two wythes in vertical direction for each square foot of panel that is at least sufficient to withstand 110 percent of the weight of each square foot of one of the concrete wythes of the panel.

In one embodiment, the insulative layer includes connecting members, referred to as two-way shear connectors which can transfer longitudinal shear loads from one wythe to the other in multiple directions. In another embodiment, they can transmit loads in all directions through the use of a plurality of continuous connectors which are mounted to the concrete wythes and extend at angles therefrom in a manner similar to a helix or corkscrew. In one embodiment they are wound around prestressed concrete reinforcing rods in the two wythes. The connectors may be formed fabricated fiber-reinforced plastic elements or rods.

To fabricate the precast concrete sandwich panels, the form work for properly shaped panels is set up. Usually the panels are right regular parallelopipeds as normally used in construction. Conventional wythe reinforcement is placed in the forms to form the bottom concrete wythe or layer. This reinforcement may be conventional and in some applications may be omitted. Typically, it is a grid of steel rods elevated from the bottom of the form work in a conventional manner such as by passing the ends through holes in the forms so that they are embedded in the bottom concrete layer.

Next, the insulative multidirectional connectors are placed above the reinforcing grid in rows no closer than 1 foot from each other and preferably 2 feet apart. They may be supported in any manner but generally are supported by strands that pass through holes in the forms. Under some circumstances they are embedded in the insulative material that is to form the middle insulative sandwich, and under other circumstances, they are free standing and supported between two strands, each of which is to be embedded in a different one of the two concrete wythes. Next, the bottom wythe is cast in concrete to encompass the prestressed rods or any holder for one side of the connectors, with the connectors passing through the surface of that wythe to extend above it.

After the first or bottom concrete layer is formed, the entire insulative layer is applied on the first concrete layer , filling in the spaces between the connectors to form a substantially continuous layer of insulative material. The connectors have ends extending above the insulative layer to be later embedded in the top concrete layer.

To form the second or top concrete layer, reinforcing is placed above the top strands of the connecters with both the top strands and the reinforcing rods being supported by the forms. The second or top wythe is cast to encompass the top strands of the connectors and the reinforcing rods. The forms can then be removed.

This process results in the two concrete layers or wythes being connected together by connectors capable of transmitting force between them in a multiplicity of directions but without any high thermal conductivity path between the two concrete slabs. Of course, prior to casting the top layer, another layer of connectors can be applied so that after the second layer is cast, another insulative layer may be completed and a third concrete layer cast on top of it in the manner described with respect to the second concrete layer. Moreover, still other additional layers may be formed as desired.

The insulative layer should generally be at least one inch in thickness and the thickness of the concrete layer is chosen in accordance with the application. While this type of precast concrete sandwich panel is most suitable for structural sandwich panels in which both layers of concrete are to bear stress, it can be used for those sandwich panels in which only one of the concrete layers will bear stress. Thus, a building can be constructed using the panels in a manner in which only one of the concrete layers will bear load between a ceiling and a foundation or the like and the other will be free floating or they can both bear load.

In the above description, it can be understood that, the construction element of this invention has several advantages, such as for example: (1) it is easily fabricated; (2) it is cost effective; (3) it provides good thermal conductivity and structural strength; and (4) it provides a superior composite precast concrete sandwich panel.

SUMMARY OF THE DRAWINGS

The above noted and other features of the invention will better understood from the following detailed description, when considered with reference to the accompanying drawings in which.

DETAILED DESCRIPTION

Figures 1, 2, 3:
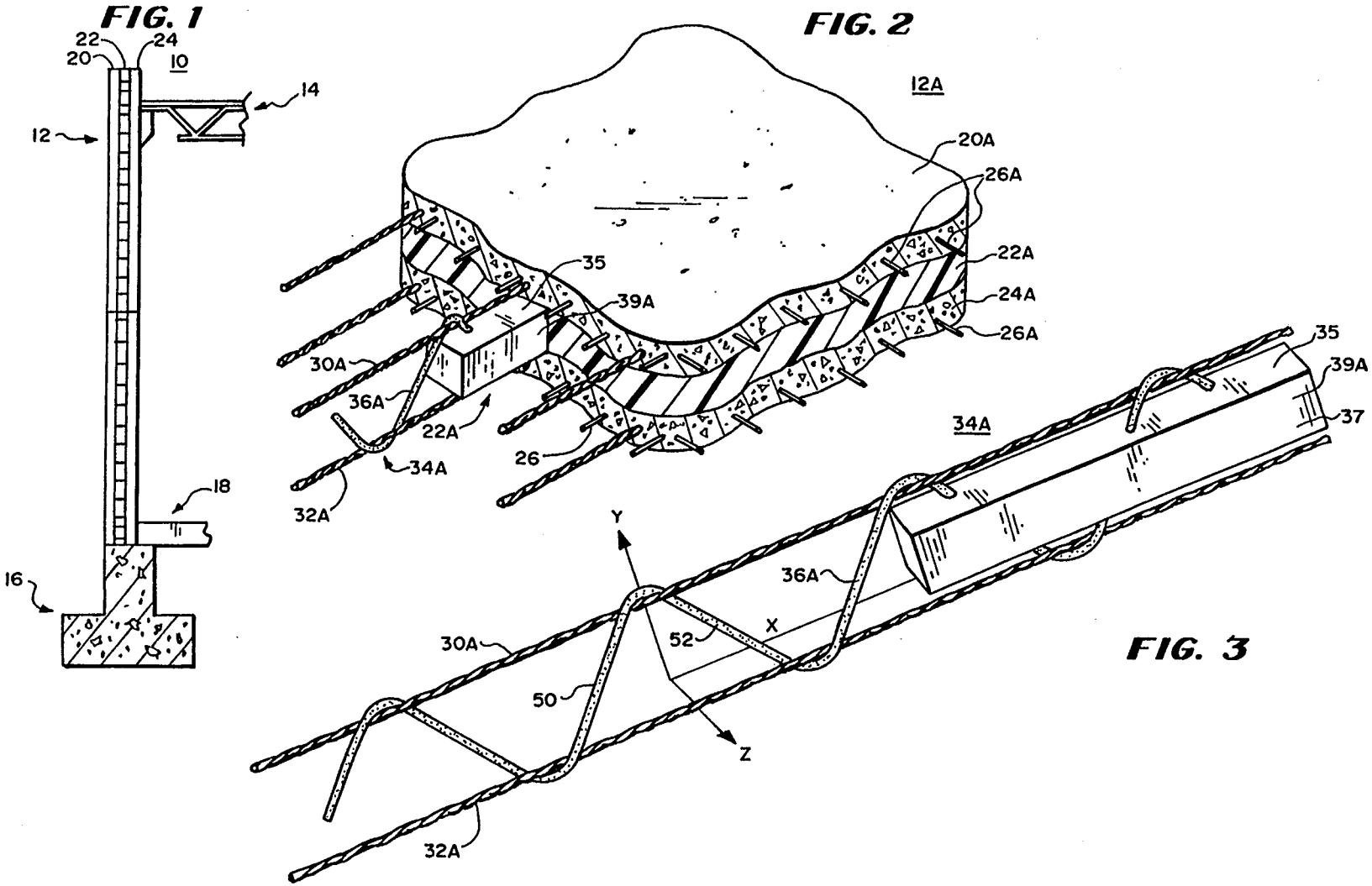
FIG. 1 is a fragmentary sectional view of a portion of a building showing a typical application of a sandwich panel in accordance with an embodiment of this invention.
FIG. 2 is a fragmentary, broken away, simplified perspective view of one embodiment of precast sandwich panel in accordance with the invention.
FIG. 3 is simplified, broken away, perspective view of a portion of the embodiment of FIG. 2.

In FIG. 1, there is shown a portion of a building having a precast concrete sandwich panel 12, a ceiling portion 14, a foundation 16 in the form of an inverted T and a floor portion 18. The precast concrete panel 12 supports the ceiling portion 14 on a corbel and rests upon the foundation 16 which also receives the flooring 18.

To provide support and insulation, the precast concrete sandwich panel 12 includes a first concrete wythe 20, an insulative layer 22 and a second concrete wythe 24. The insulating layer 22 is capable of transmitting force in vertical planes perpendicular to the surfaces of the wythes 20 and 24 at both acute and obtuse angles to the surface of the wythes so that it forms a composite panel. There are no high thermal conductivity paths extending from contact with the wythe 20 to the wythe 24 such as would be the case with a metal truss connector between the two wythes. Instead, the wythes 20 and 24 are connected together through fiber reinforced plastic members.

In FIG. 2, there is shown a fragmentary perspective view of a portion of a prestressed concrete sandwich panel 12A having a first concrete wythe 20A, a layer of insulation 22A and a second concrete wythe 24A mounted together in a sandwich panel. In this view, the sandwich panel 20A is broken away to illustrate the manner in which connector assemblies connect the first and second precast concrete wythes 20A and 24A and transmit forces therebetween without providing high thermal conductivity paths between them.

The precast concrete wythes 20A and 24A are conventional precast concrete layers having typical reinforcement, which in the embodiment of FIG. 2 takes the form of a grid of rods 26A. The connector assembly includes portions mounted in each of the first and second precast concrete wythes 20A and 24A.

The insulation layer 22A also includes portions of the connector assembly and may be any conventional insulating type material such as polystyrene. The connector assembly may include precast portions such as blocks of the insulation material or may be separate and inserted during casting or laying down of the insulation layer 22A. In most embodiments, sections of the insulation material are precast with the connector element in place in a manner to be described.

The connector assembly includes prestressed strands 30A and 32A, and the fabricated fiber reinforced plastic rod connectors 36A. In this embodiment, insulative blocks 39A are precast with portions of the fabricated fiber reinforced rod connectors extending through them. The prestressed strands 30A and 32B are cast within the first and second concrete wythes 20A and 24A together with a portion of the fiber reinforced rod connectors 36A which extend around them. The remainder of the fiber reinforced plastic connectors are within the insulative material 39A of the insulative layer 22A.

In FIG. 3, there is shown a fragmentary, perspective view partly broken away of a connector assembly 34A having a precast insulation block 39A, first and second prestressed rods 30A and 32A and a fiber-reinforced plastic rod 36A. The prestressed rods 30A and 32A are embedded in the first and second concrete wythes 20A and 24A (FIG. 2). The fiber-reinforced plastic rod 36A is wound around them and extends into the first and second concrete wythes 20A and 24A and has lengths extending through the precast insulation block 39A.

In the preferred embodiment, the precast insulation block 39A is shaped as an elongated right regular parallelopiped with a top flat surface 35 in contact with the first concrete wythe 20A and a second surface 37 at right angles to the surface 35 extending orthogonally to and between the first and second concrete wythes 20A and 24A (FIG. 2). Of course, other shapes can be used such as for example the surface 37 may also be stepped or notched to inhibit concrete squeezing between the two interior surfaces.

To aid in this description, a Cartesian coordinate system is drawn in FIG. 3, having an origin in the precast insulation block 39A adjacent to the top surface of the first or lower precast concrete wythe 20A (FIG. 2), its x axis bisecting the bottom surface of the block 39A and being in the same plane as the central longitudinal axis of the elongated, precast, insulation block 39A, which plane bisects its top and bottom surfaces, its y axis perpendicular to the surface 35 and being in the same plane as the longitudinal axis of the block 39A which plane bisects the top and bottom surfaces of the block 39A and its z axis being perpendicular to the plane of the side 37 and to the xy plane.

For convenience, a first loop of the fiber reinforced fabric rod 36A is shown at 50 and a second loop at 52, each wound around a different one of the prestressed strands 30A and 32A, adjacent to and displaced longitudinally along the axis of the block 39A from each other and at an angle to each other forming one spiral of the cylindrical helix into which the rod 36A is formed. As shown in FIG. 3, the strands 50 and 52, when placed in tension by shear forces between the first and second concrete wythes 20A and 24A (FIG. 2) or by forces between the two that tend to pull them part, transmit components of that force at an angle to all three of the Cartisian planes, the xy plane, the xz plane and the yz plane because of the angle form to those planes.

Because the fiber reinforced fabric rod 36A can transmit forces at angles to all three planes, this connector member can resist forces in every direction except compressive forces which are adequately resisted by the precast insulative layer 22A (FIG. 2) and which are normally not severe in a a sandwich panel construction element. Most importantly, this connector resists shear forces between the two concrete wythes in both vertical directions to create a composite precast concrete fiber panel while using only insulative connectors.

Figure 4:
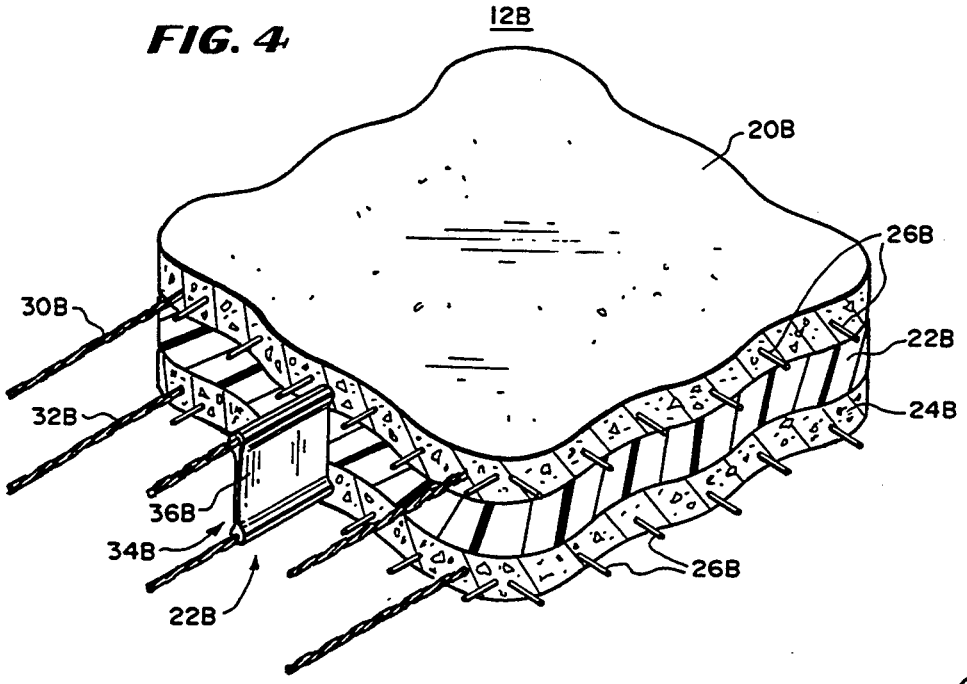
FIG. 4 is a fragmentary, broken away, perspective view of another embodiment of precast sandwich panel in accordance with an embodiment of the invention.

In FIG. 4, there is shown a simplified fragmentary, perspective view of another embodiment of precast concrete sandwich panel 12B having first and second concrete wythes or layers 20B and 24B, a centrally located layer of insulative material 22B and one of a plurality of connectors 34B located in parallel rows between the first and second wythes 20B and 24B, each including a different pair of prestressed rods that are in pairs of two and parallel to each other such as the rods 30B and 32B.

This embodiment is similar to the embodiment of FIG. 2 and 3 except that the connector assemblies 34B are not entirely continuous except for the rods 30B and 32B in the first and second concrete wythes 20B and 24B and do not have components of force in all three planes but do have components of force during shear between the first and second concrete wythes 20B and 24B at all angles in the xy plane.

Figure 5:
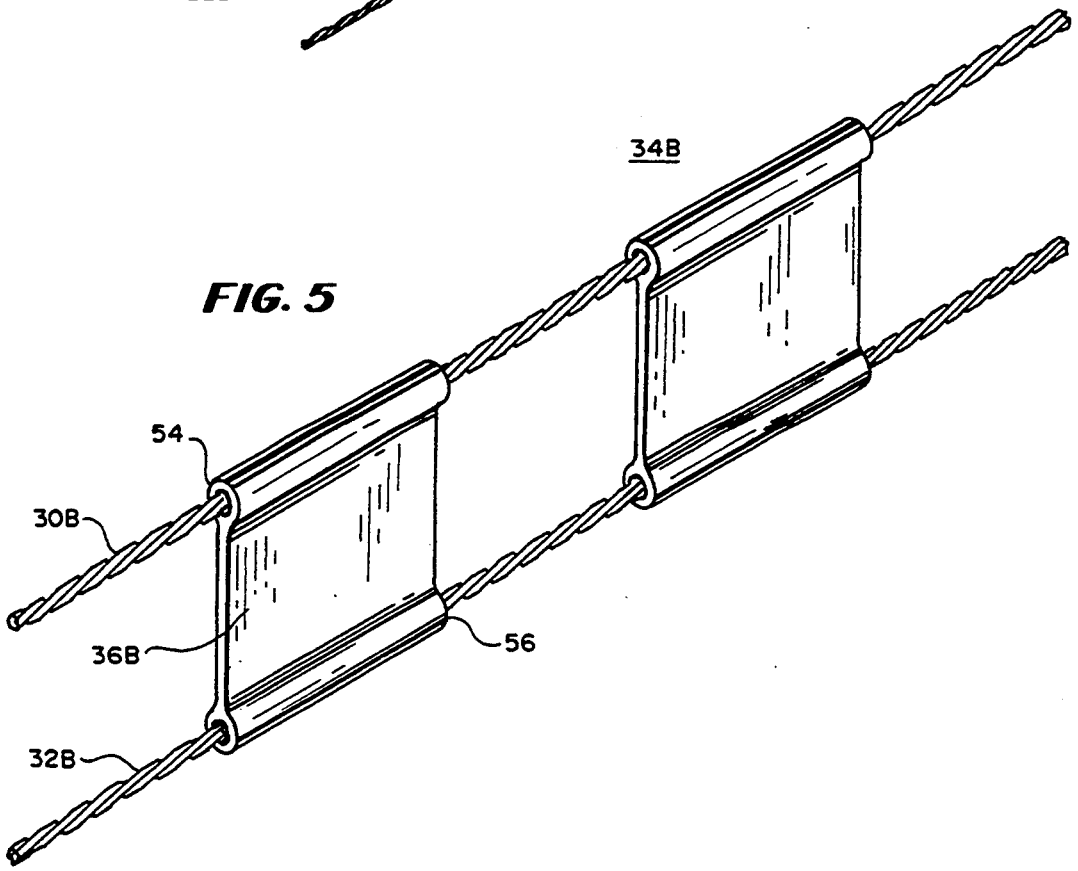
FIG. 5 is a fragmentary, further broken away, simplified, perspective view of the embodiment of FIG. 4.

In FIG. 5, there is shown a simplified perspective view of the connector assembly 34B mounted to the prestressed strands 30B and 32B that are embodied in the first and second concrete wythes 20B and 24B (FIG. 4). As shown in this view, forces are transmitted in the xy plane through the thin solid sheet 36B of fiber reinforced plastic fabric between prestressed strands 30B and 32B embedded within the concrete. Such forces are extended at an angle, such as for example, between the corner 54 on one side of a connector to the corner 56 on another side spaced in the xy plane from 54 both in a direction perpendicular to the surfaces of the concrete wythes and parallel to the surfaces. While generally in fabricating the wythes, the prestressed strands 30B and 32B will run parallel to each other in a single direction, such as vertical and parallel to the sides of the prestressed concrete sandwich panel, they can run in different directions or at angles so as to tailor the direction of the stresses and extend them into multiple planes.

Figure 6:
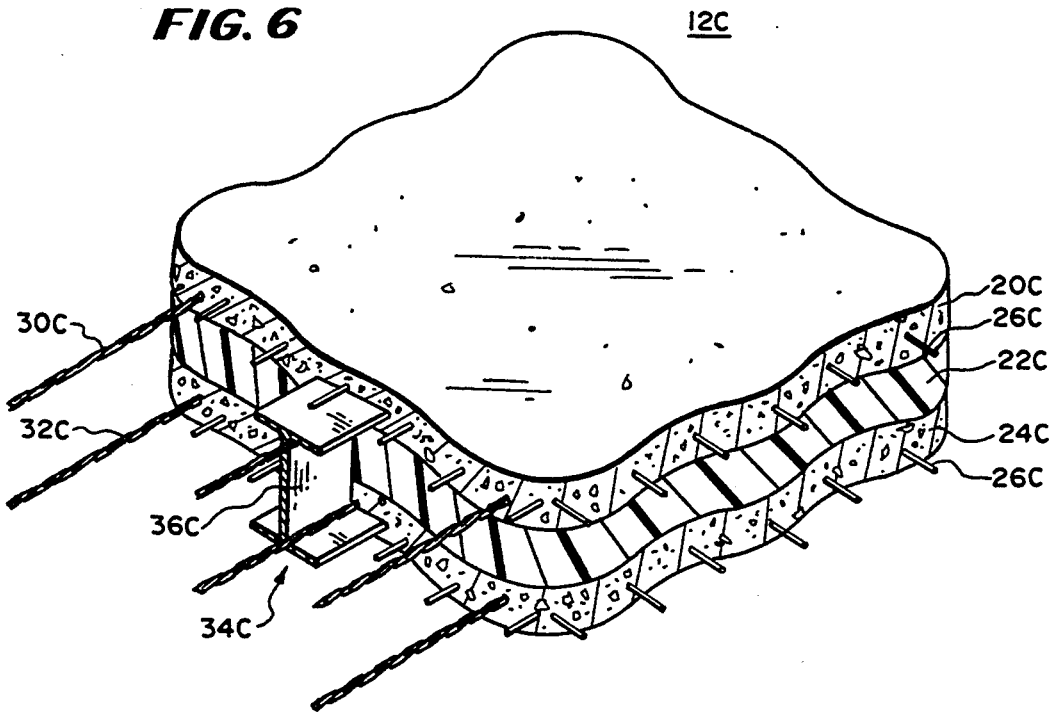
FIG. 6 is a fragmentary, broken away, simplified, perspective view of still another embodiment of the invention.

In FIG. 6, there is shown a fragmentary simplified, perspective view of a precast concrete panel 12C showing still another embodiment of connector assembly 34C. The first and second concrete wythes 20C and 24C and the insulation layer 20C, 24C and 22C are the same as in the other embodiments for all substantial purposes but the connector assembly 34C includes as a fiber reinforced plastic connector 36C, an I shaped structure which has flanges resting on the outside of the space between a pair of prestressed strands 30C and 32C.

Figure 7:
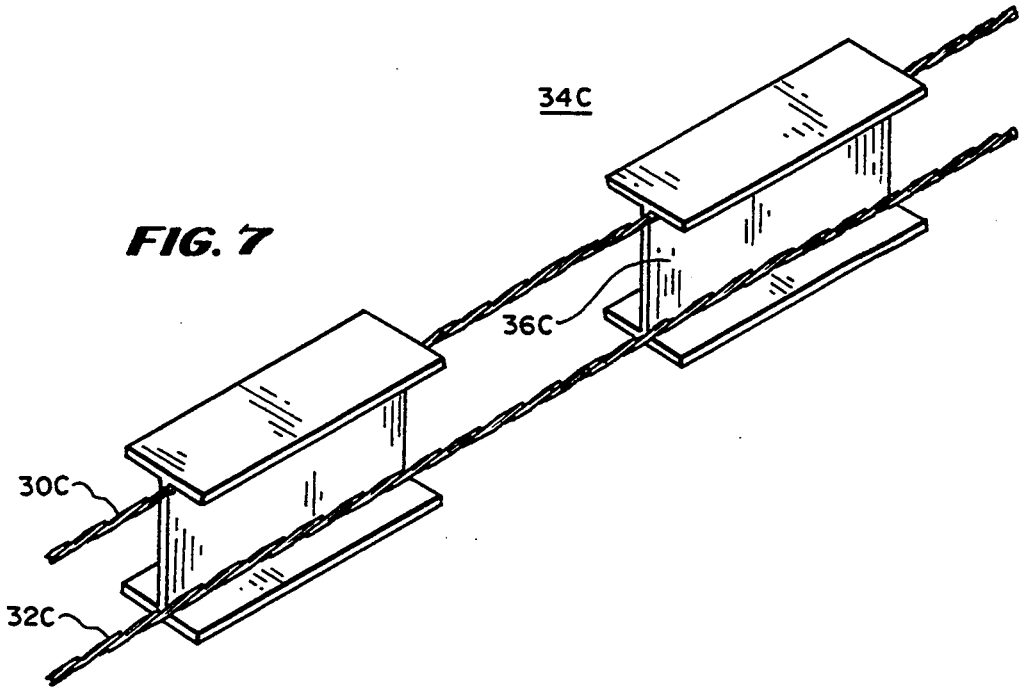
FIG. 7 is a fragmentary, further broken away, simplified, perspective view of the embodiment of FIG. 6.

As best shown in FIG. 7, the connectors are spaced longitudinally along a pair of rods 30C and 32C and there are a plurality of parallel rows of rods and connectors positioned side by side across the panels. The concrete holds the flanges of the I shaped members 36C in place so that forces can be transmitted through the web of the members in a manner similar to the transmission of forces in the web of the connectors 36B of FIG. 5. However, these connectors may be more easily assembled since, unlike the connector of FIG. 5, the prestressed strands 30C and 32C do not have to fit through loops in the fiber reinforced plastic connecting elements as is the case with the strands 30B and 32B and the element 36B shown in FIG. 5, but instead simply rest on the prestressed members 30C and 32 with the web stretching between them.

Figure 8:
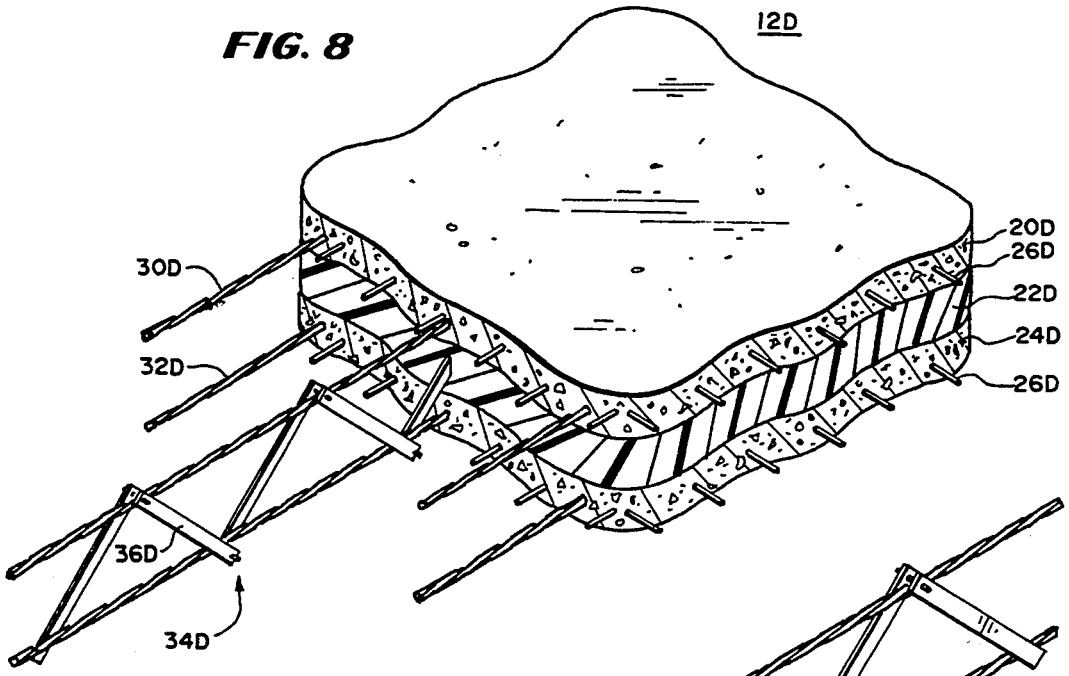
FIG. 8 is a fragmentary, broken away, simplified view of still another embodiment of the invention.

In FIG. 8, there is shown still another embodiment of precast concrete sandwich panel 12D with a structure similar to the other embodiments except that the plurality of parallel connector assemblies 34D are composed of straps stapled or hinged together on opposite sides of the prestressed strands instead of continuous web or rod or shaped member. The straps shown at 36D are spaced at angles so as to have components of force in the xy plane.

Figure 9:
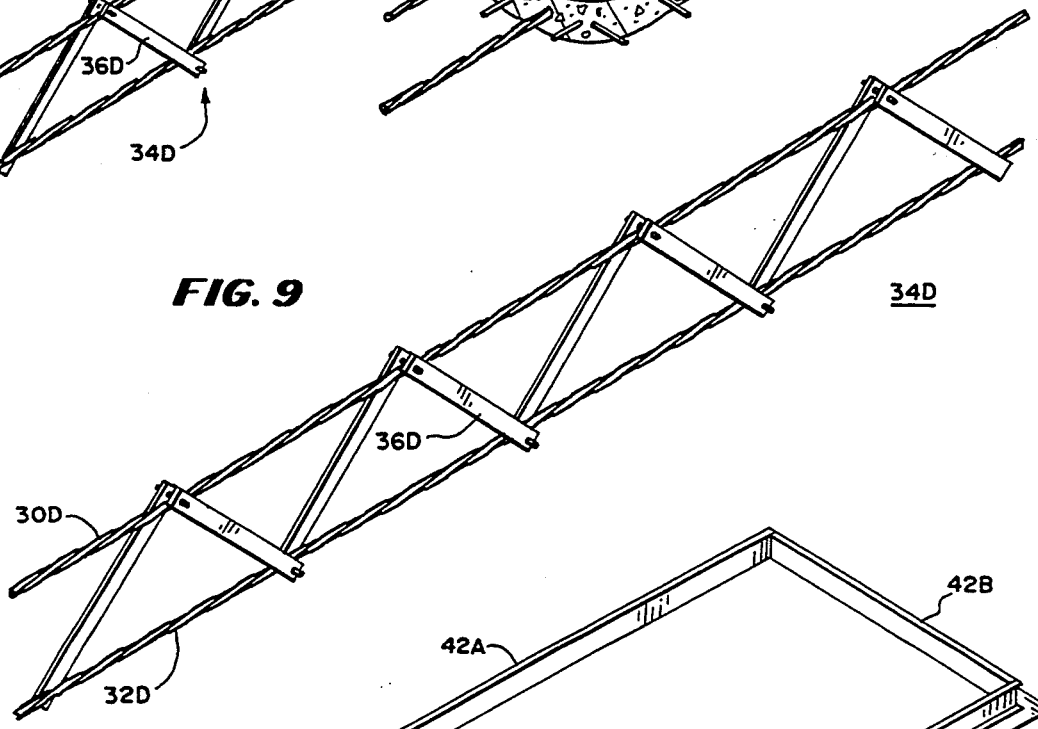
FIG. 9 is a fragmentary, further broken simplified view of the embodiment of FIG. 8.

As best shown in FIG. 9, adjacent straps in one of a plurality of parallel lines of straps are at an angle to each other and stretch between the prestressed strands or rods 30D and 32D with their ends extending into the concrete. On an upper end of the strand 30D, rods which meet are joined together and on the opposite side of the strand 32D the adjacent rods are stapled together so as to form a zigzag path of straps that can transmit tension force through the first and second precast concrete wythes. This embodiment permits the connector assembles to be folded together for shipment.

Figure 10:
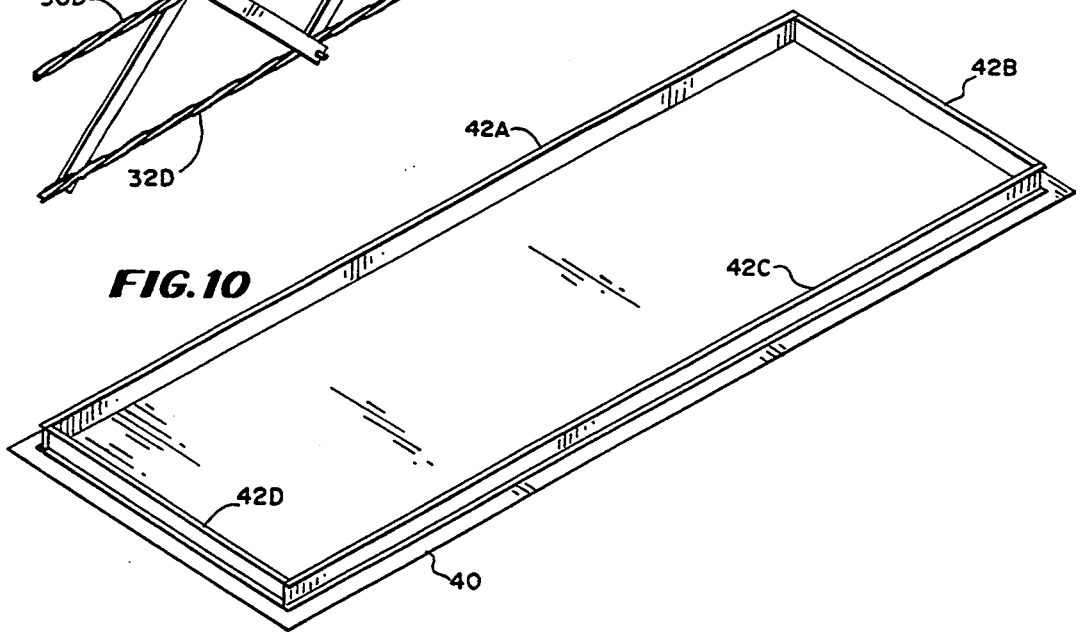
FIG. 10 is a perspective view showing one step in the formation an embodiment of the invention.

In FIG. 10, there is shown a perspective view illustrating a first step in the formation of the precast concrete sandwich panels. As shown in this embodiment, forms are set up to form a slab of the appropriate size for the panel. Generally, these may include a bottom steel plate and side plates 42A–42D forming sides of the right regular parallelepiped. However, other shapes can be utilized to form any special shape of sandwich panel desired. Thus, they can be formed with apertures at different locations or with different contoured shapes or with bottom and tops surfaces which are ornamental.

Figure 11:
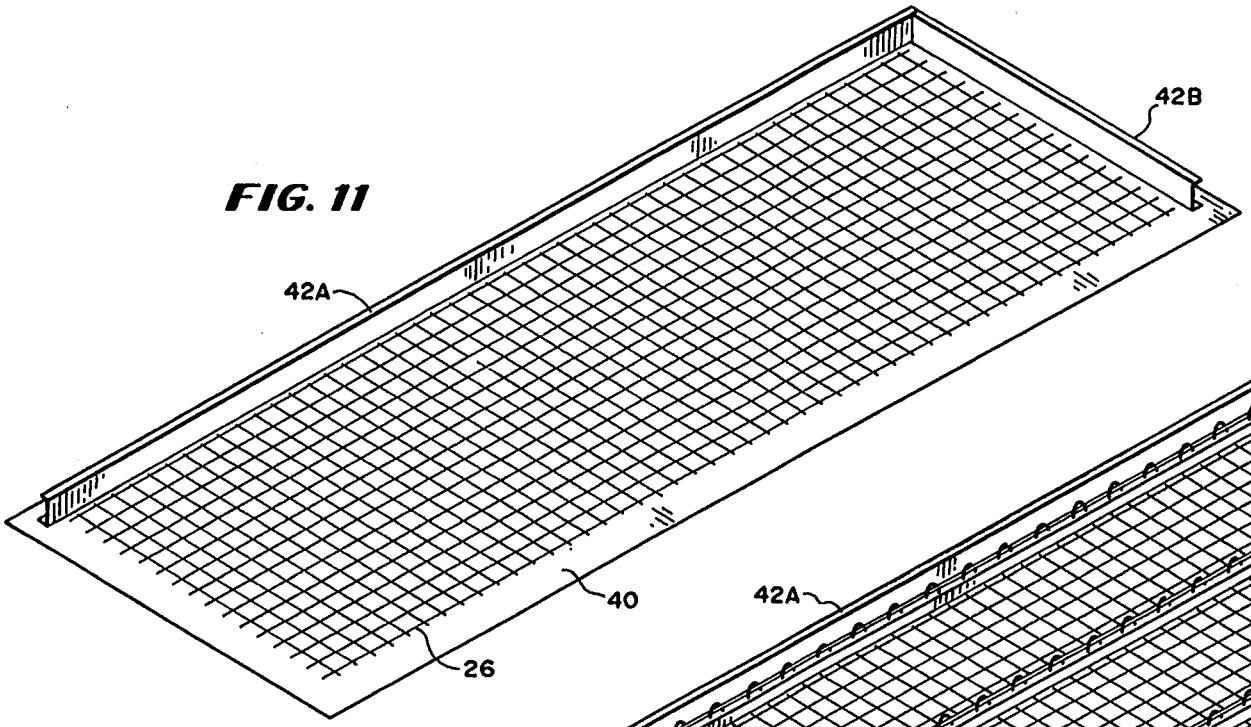
FIG. 11 is a perspective view showing a second step in the fabrication of an embodiment of the invention.

In FIG. 11, a second stage is illustrated, in which for clarity, two of the side plates 42C and 42D (FIG. 10) are removed. As shown in this view, after the forms are set up, the second or bottom concrete wythe reinforcement is positioned in the forms on top of the plate so that the concrete can be casted around it to provide conventional concrete reinforcing members.

Figure 12:
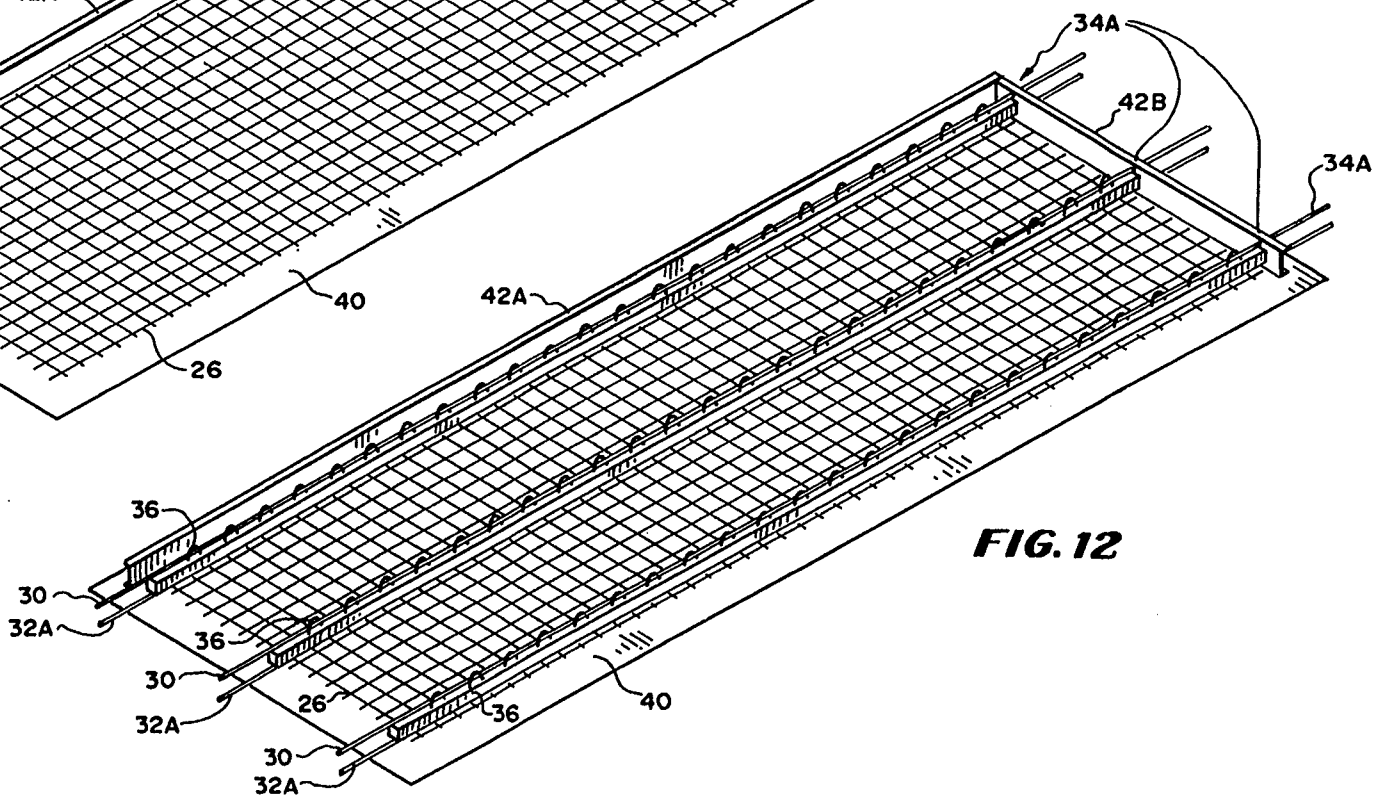
FIG. 12 is a perspective view illustrating another step in the fabrication of an embodiment of the invention.

In FIG. 12, there is shown a third step in the fabrication of the panels, again having two of the side forms removed for clarity, showing the placement of the connector assemblies 34A in place with a plurality of them extending parallel to each other across the width of the forms. The number is selected for the amount of load that is to be transferred but generally, the placement will be symmetrical, although different strength characteristics can be obtained by changing the angles of them such as having two parallel side members and one diagonal member. These are placed so the reinforcing members 26 and the bottom prestressed members 32A are in similar vicinity where they can be covered by the concrete cast to form the second concrete wythe 24A (FIG. 2).

Figure 13:
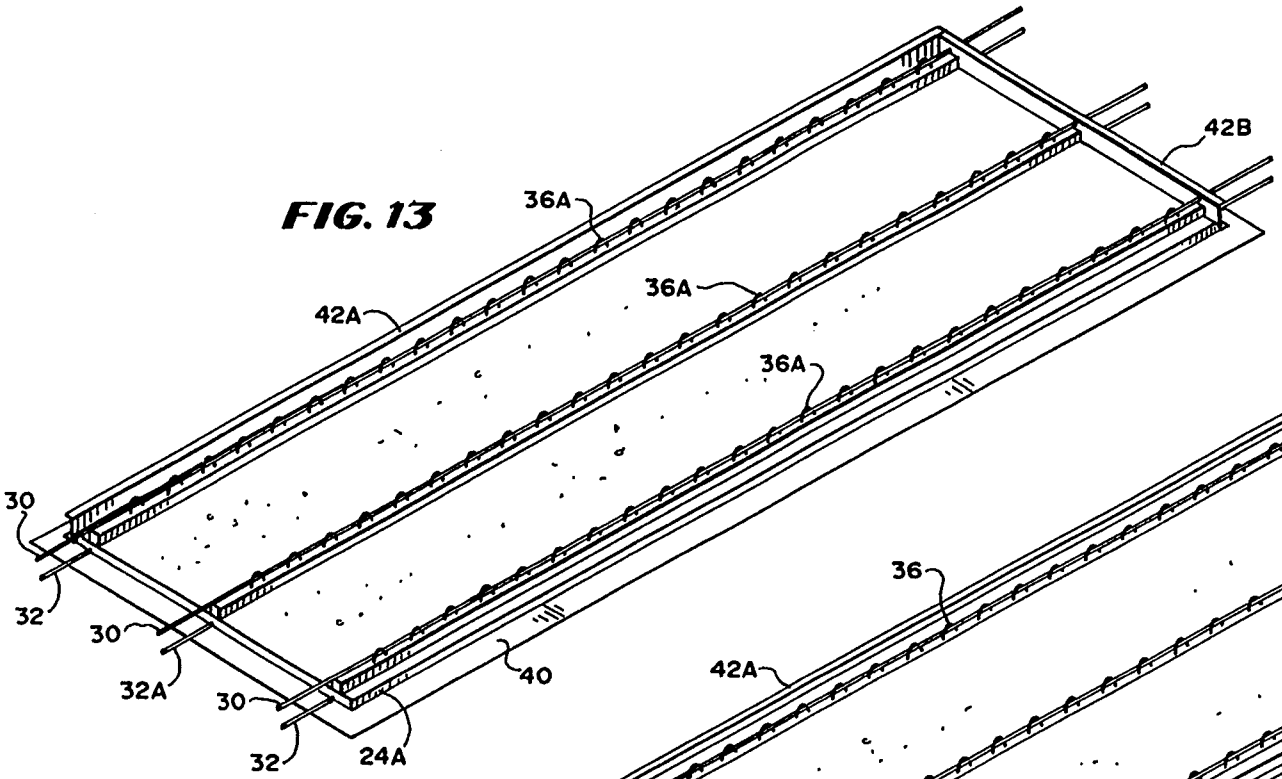
FIG. 13 is a perspective view illustrating still another step in the fabrication of an embodiment of the invention.

In FIG. 13, there is shown a fourth step in which the second or bottom wythe 24A is cast so that it is adjacent to the elongated insulative strips 39A. This casting is accomplished so that ends of the fiber reinforced plastic rod 36A and the bottom prestressed strand 32A are in embedded within the concrete of the second or bottom wythe 24A.

Figure 14:
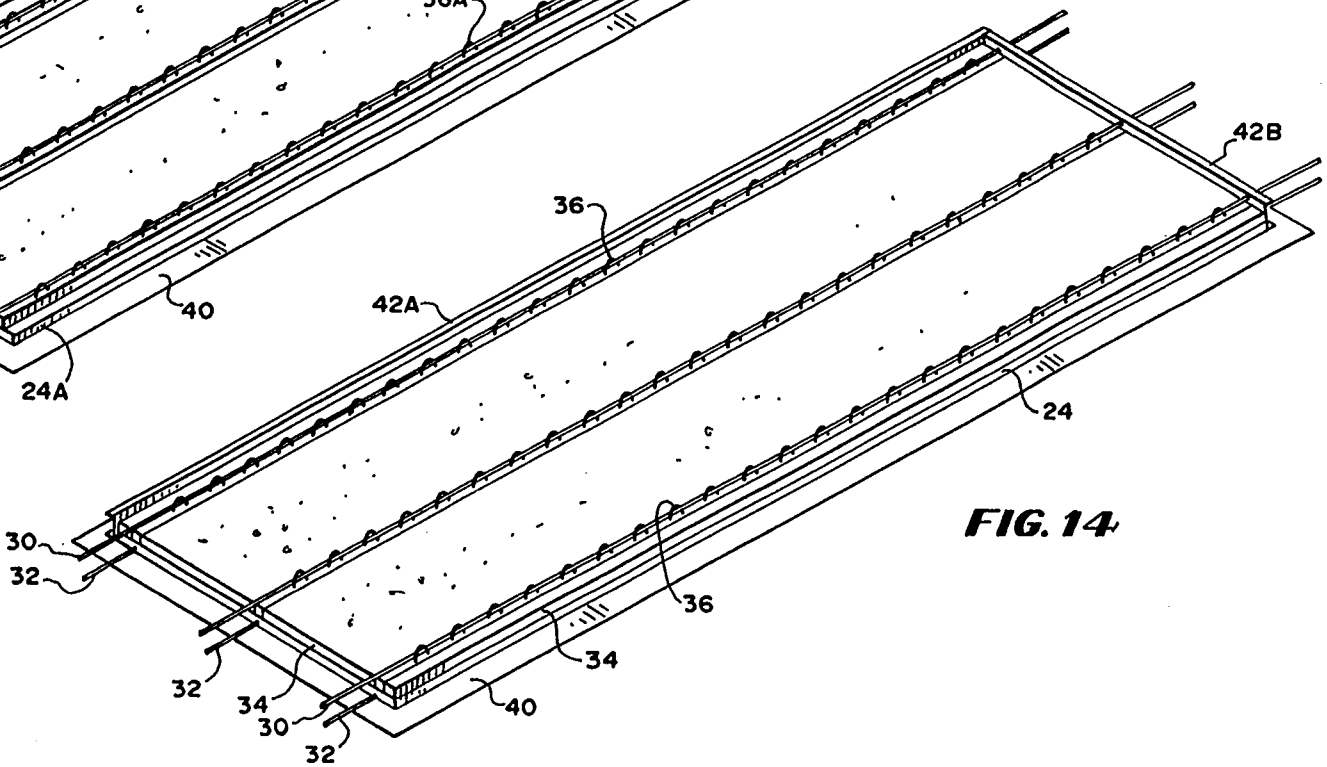
FIG. 14 is a perspective view illustrating still another step in the fabrication of an embodiment of the invention.

In FIG. 14, there is shown a fifth step in the formation of the precast concrete sandwich panel, in which step, the remainder of the insulative layer 22A is formed either by casting in place or, as shown in FIG. 14, by placing slabs to fill in the space within the four forms and the members 39A and establish an insulative layer. Of course, forms may be used to form apparatures omitting the insulation if desired, or different kinds of insulation may be used in different locations or even void spaces although generally, a solid complete insulative layer is formed without high thermal conductivity paths extending from the bottom concrete wythe 24 upwardly where it into contact the top concrete wythe.

Figure 15:
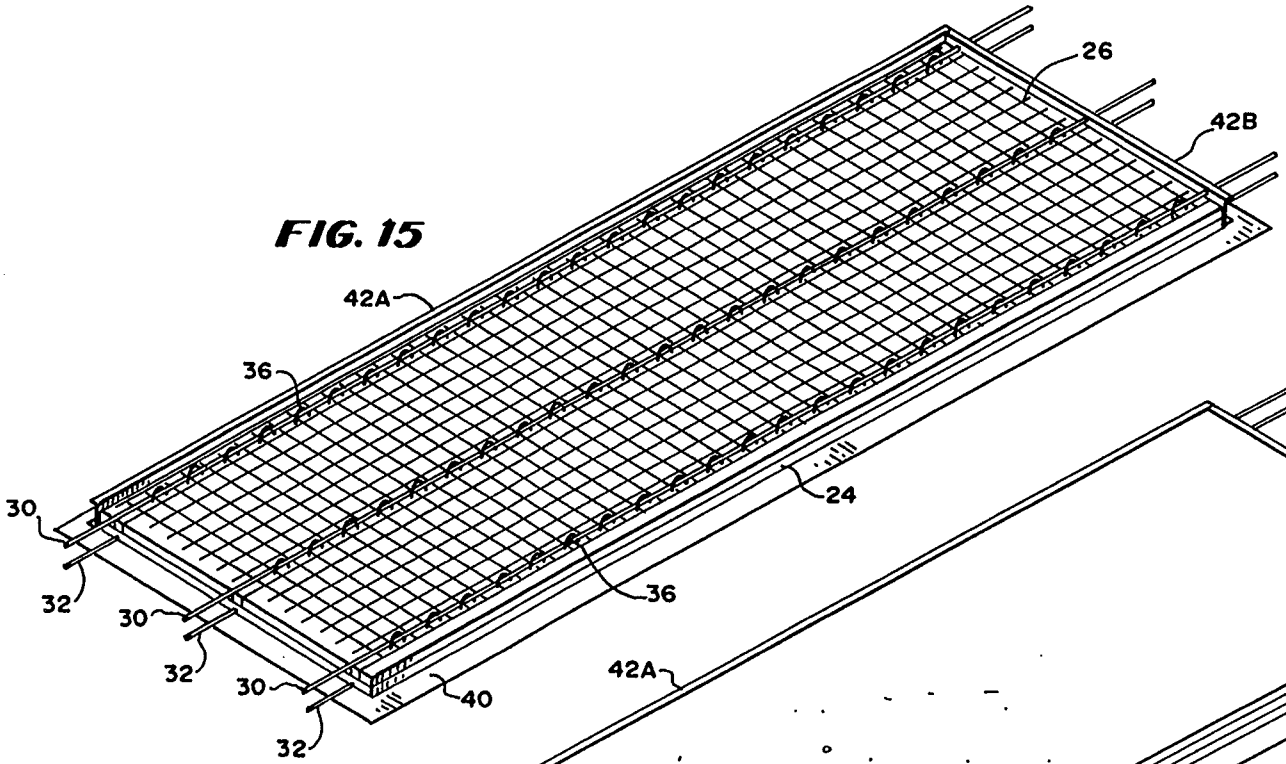
FIG. 15 is a perspective view illustrating still another step in the fabrication of an embodiment of the invention.

In FIG. 15, there is shown a sixth step in forming the precast concrete sandwich panel which is the placement of the concrete reinforcement in the vicinity of the top prestressed strands 30A and the tops of the fiber reinforced plastic rods through which the prestressed strands 30A have been inserted in connecting fashion.

Figure 16:
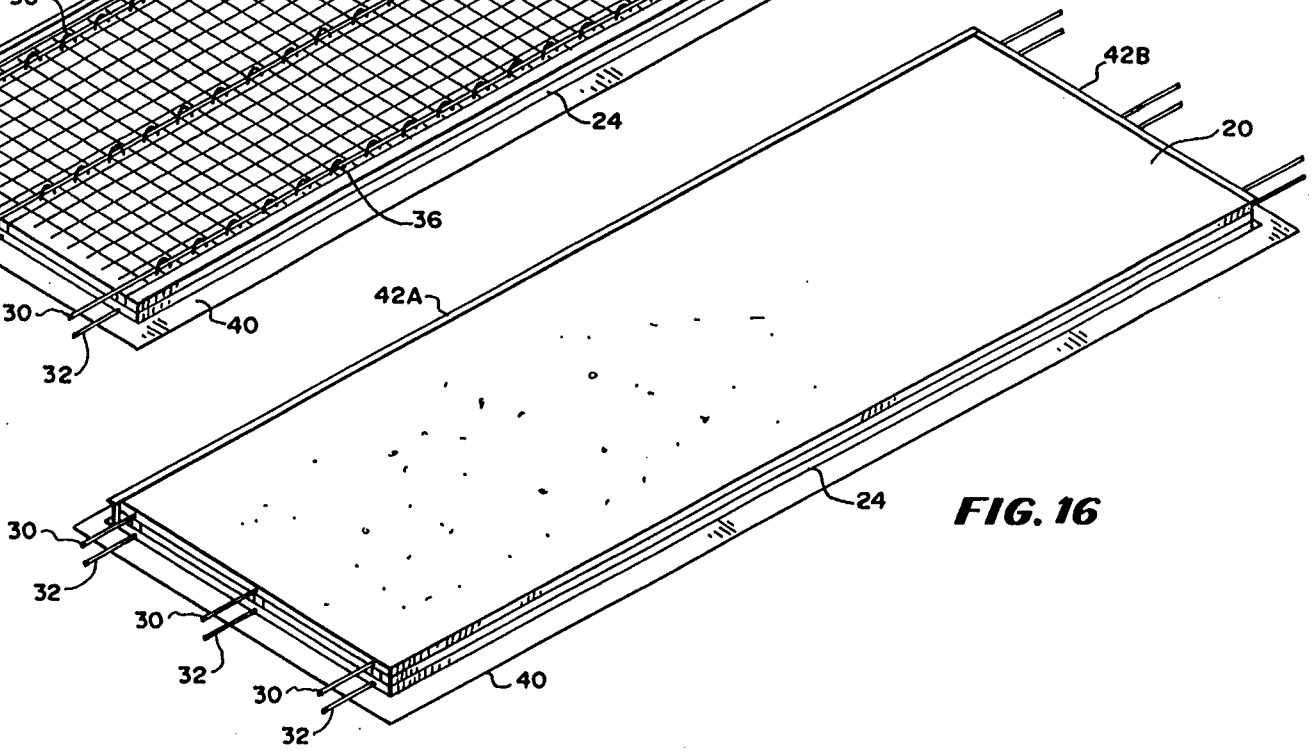
FIG. 16 is a perspective view illustrating still another step in the fabrication of an embodiment of the invention.

In FIG. 16, the first or top concrete wythe or layer is 20A is formed so that the reinforcing members 26 are embedded within it as well as the prestressed strands, over which the fiber reinforced plastic rods 36A looped to form a connector between the first and second concrete layers 20A and 24A. Of course, more than two concrete layers can be utilized with insulation between them in an analogous manner.

To do so, before casting the first or top concrete wythe 20A, another layer of prestressed rods and corresponding set of connectors would be placed so that they are embedded in the layer of concrete 20A with the connectors extending upwardly into an area for insulation and for a third concrete wythe. Before the third wythe is cast, the spaces between insulative connectors is filled by insulation and finally the third concrete wythe is cast. Also, other types of connectors can be used for the third layer so it does not bear load while the first and second concrete layers do bear full load.

The connector assemblies 34A–34D (FIGS. 2–9) are formed so that all thermal paths between the two concrete layers contain material having a thermal conductivity of no more than 3 BTUs per hour, per square foot in area, per inch in thickness with a one degree Fahrenheit difference in temperature.

The concrete wythes 20A–20D and 24A–24D are connected to each other by connectors which can transmit the force at least in planes perpendicular to the surface of the two concrete wythes 20A–20D and 24A–24D and a line between the two parallel edges of each of the panels 12A–12D (FIGS. 2, 4, 6, and 8) and parallel thereto at a plurality of different angles to the surfaces of the panel within the planes at both acute and obtuse angles thereto, whereby the sandwich panel is a composite panel.

The vertically mounted concrete layers are connected to each other through members that can transmit the force at least in vertical planes perpendicular to the surface of the two concrete wythes 20A–20D and 24A–24D and at a plurality of different angles to the surfaces of the panel within the planes at both acute and obtuse angles thereto, whereby the sandwich panel is a composite panel.

Preferably, the connectors in the insulative layer are capable of transmitting a shear force that is at least 50 percent of the shear forces between the pairs of concrete wythes 20A–20D and 24A–24D that would be theoretically taken up by an infinitely rigid connector connecting the two concrete wythes. The connectors provide a tensile strength and a compressive strength along the connectors sufficient to provide this shear force and to support load on either concrete wythe.

Thus, the connectors take up at least 50 percent of the full composite action shear forces. Fully composite shear force is the theoretical limit developed with an infinitely rigid connector between the two wythes.

The connectors provide a shear strength between the two panels in either vertical direction for each square foot of panel that is at least sufficient to withstand the 110 percent of the weight of each square foot of one of the concrete wythes of the panel.

From the above description, it can be understood, that the precast concrete sandwich panel of this invention and buildings made from it have several advantages, such as: (1) they are easily fabricated; (2) they provide good thermal insulation; (3) they are true composite panels and can conduct shear forces in any direction and bear load fully as a structural element; and (4) they can be easily and conveniently precast to accomodate many different forms and loads.

While a preferred embodiment of the invention has been described with some particularity, many modifications and variations of the invention are possible in light of the above teachings. It is therefore to be understood that, within the scope of appended claims, the invention may be practiced other than as specifically described.

What is claimed is:

1. A composite precast concrete sandwich panel comprising:

a first concrete slab having at least a first planer surface;

a second concrete slab having at least a second planer surface substantially parallel to said first planer surface;

a layer of insulation comprising at least one insulating material between said first and second concrete slabs;

connecting means comprising at least a portion of said insulating material holding said first and second concrete slabs together wherein all thermal conductivity paths between the first and second concrete slabs have a thermal conductivity less than 3 BTU's per hour, per square foot in area, per inch in thickness for 1 degree Fahrenheit;

said connecting means including at least a first elongated strand embedded in said first concrete slab having a first plurality of sections substantially parallel to said at least a first planar surface; at least a second elongated strand embedded in said second concrete slab having a second plurality of sections substantially parallel to said at least a second planer surface; and at least one elongated member having a longitudinal axis extending at least over a portion of its length at an angle to the normal to said first planer surface;

said at least one elongated member connecting sections of said at least a first elongated strand with sections of said at least a second elongated strand wherein said at least a first elongated strand is held to said at least a second elongated strand;

said connecting means providing resistance to shear in at least two directions with a shear strength between the first concrete slab and second concrete slab at least sufficient to withstand 110 percent of the weight of each square foot of one of the first and second concrete slabs, wherein the connecting means takes up at least 50 percent of the full composite action shear forces.

2. A panel in accordance with claim 1 in which the at least one elongated member is mounted at opposite ends to different ones of the concrete slabs and includes heat insulative high tensile strength members extending in more than one direction between the concrete slabs.

3. A panel in accordance with claim 2 in which the at least one elongated member includes at least one fiber reinforced plastic member.

4. A building containing at least one precast concrete sandwich panel, comprising:

said precast concrete sandwich panel being mounted to carry load;

said panel comprising at least a first and second concrete slab and insulative material between first and second concrete slabs;

said panel being a composite structural panel in which every thermal conductivity path has a thermal conductivity less than 3 BTU's per hour, per square foot in area, per inch in thickness for 1 degree Fahrenheit between the first and second concrete slabs; said panel including at least a first elongated strand embedded in said first concrete slab having a first plurality of sections substantially parallel to said at least a first planar surface; at least a second elongated strand embedded in said second concrete slab having a second plurality of sections substantially parallel to said at least a second planar surface; and at least one elongated connecting member; said at least one elongated connecting member having a longitudinal axis and being capable of transmitting tensile forces in at least two directions between said first and second concrete slabs at an angle to the normal of surfaces of said first and second concrete slabs and being of good thermal insulated material having a thermal conductivity less than 3 BTU's per hour, per square foot in area, per inch in thickness for 1 degree Fahrenheit positioned between and connecting said first and second concrete slabs;

said at least one elongated member connecting sections of said at least a first elongated strand with sections of said at least a second elongated strand wherein said at least a first elongated strand is held to said at least a second elongated strand.

5. A building in accordance with claim 4 in which the connecting elements are fiber reinforced plastic.

* * * * *